US005276461A

United States Patent [19]

Saito

[11] Patent Number: 5,276,461

[45] Date of Patent: Jan. 4, 1994

[54] ELECTROPHOTOGRAPHIC PRINTING DEVICE

[75] Inventor: Akihiro Saito, Shizuoka, Japan

[73] Assignee: Tokyo Electric Co., Ltd., Tokyo, Japan

[21] Appl. No.: 509,597

[22] Filed: Apr. 13, 1990

[30] Foreign Application Priority Data

Apr. 18, 1989 [JP] Japan ..... 1-98319
May 15, 1989 [JP] Japan ..... 1-120745

[51] Int. Cl.[5] ..... B41J 2/47; G03G 21/00; H01R 13/62

[52] U.S. Cl. ..... 346/107 R; 355/202; 439/153

[58] Field of Search ..... 346/107; 355/208, 209, 355/202, 206, 211; 439/152, 153, 155, 157, 159, 160

[56] References Cited

U.S. PATENT DOCUMENTS

| | | | |
|---|---|---|---|
| 3,512,885 | 5/1970 | Osborne et al. . | |
| 4,449,813 | 5/1984 | Kikuchi et al. . | |
| 4,496,237 | 1/1985 | Schron | 364/550 X |
| 4,511,000 | 4/1985 | Mims . | |
| 4,551,000 | 11/1985 | Kanemitsu et al. | 355/210 |
| 4,585,327 | 4/1986 | Suzuki | 355/211 |
| 4,780,806 | 10/1988 | Wada et al. . | |
| 4,806,978 | 2/1989 | Nakatani et al. | 355/202 |
| 4,810,200 | 3/1989 | Sakamoto | 439/155 |
| 4,851,875 | 7/1989 | Tanimoto . | |
| 4,855,754 | 8/1989 | Tanaka et al. | 355/206 X |
| 4,870,459 | 9/1989 | Ito et al. . | |
| 4,882,604 | 11/1989 | Kato et al. | 355/202 X |
| 4,930,101 | 5/1990 | Wong et al. | 364/900 |
| 4,974,020 | 11/1990 | Takamatsu et al. | 355/208 |
| 4,994,853 | 2/1991 | Fukuchi et al. | 355/208 |
| 5,066,978 | 11/1991 | Watarai . | |

FOREIGN PATENT DOCUMENTS

| | | |
|---|---|---|
| 0227242A1 | 7/1987 | . |
| 56-50341 | 5/1981 | Japan . |
| 62-75468 | 4/1987 | Japan . |
| 62-96964 | 5/1987 | Japan . |
| 63-6575 | 1/1988 | Japan . |
| 64-44887 | 2/1989 | Japan . |

OTHER PUBLICATIONS

Japan Abstract 59-61854 (A), vol. 8, No. 165 (P-291)[1602], Jul. 31, 1984.

Japan Abstract 63-306462, vol. 13, No. 141 (P-853)[3489], Apr. 7, 1989.

Japan Abstract 59-93466, vol. 8, No. 211 (P-303)[1648], Sep. 26, 1984.

*Primary Examiner*—George H. Miller, Jr.
*Assistant Examiner*—David Yockey
*Attorney, Agent, or Firm*—Frishauf, Holtz, Goodman & Woodward

[57] ABSTRACT

A laser printer comprises a cartridge of a photosensitive unit, a printing mechanism for effecting a printing operation by electrifying a photosensitive member of the photosensitive unit, applying a light beam to the electrified photosensitive member to form an electrostatic latent image thereon, developing the electrostatic latent image to create a visible image and then transferring the image to printing paper, and a nonvolatile memory for storing data indicating the printing history of the photosensitive unit. The printing device further comprises a microprocessor for updating the data stored in the nonvolatile memory each time the printing operation is effected, checking whether the data stored in the nonvolatile memory has reached a value corresponding to a service life of the photosensitive unit, and generating a replacement requiring signal when it is detected that the data stored in the nonvolatile memory has reached the value.

1 Claim, 11 Drawing Sheets

ELECTROPHOTOGRAPHIC PRINTING DEVICE

BACKGROUND OF THE INVENTION

1. Field of the Invention

This invention relates to an electrophotographic printing device using a photosensitive unit which is required to be periodically replaced.

2. Description of the Related Art

In general, a laser printer has a photosensitive unit. The service life of the photosensitive unit terminates when a number of printing operations are effected and it becomes necessary to replace the photosensitive unit. With the laser printer, an electrostatic latent image is formed on the photosensitive surface of the photosensitive unit and then toner is supplied to the photosensitive surface. Part of the toner is attached to the photosensitive surface according to the electrostatic latent image and the remaining toner is fed as spent or used toner into a used-toner box.

The amount of used toner increases as the printing operation is repeatedly effected. Conventionally, the capacity of the used-toner box is so set that the used-toner box will be filled with the used toner when printing operations of a number corresponding to the replacement time of the photosensitive unit are effected, and the service life of the photosensitive unit is checked according to an output signal generated from a used-toner sensor mounted on the used-toner box when it has detected that the used-toner box is filled with the used toner.

However, if the replacement time of the photosensitive unit is determined according to the amount of the used toner stored in the used-toner box, it is impossible to detect the optimum replacement time of the photosensitive unit since the amount of used toner obtained in each printing operation may vary according to the printing operation. The used-toner sensor is relatively expensive and it is difficult to lower the manufacturing cost.

SUMMARY OF THE INVENTION

An object of this invention is to provide an electrophotographic printing device in which a photosensitive unit can be replaced at an optimum replacement time.

The above object is attained by an electrophotographic printing device comprising a cartridge of a photosensitive unit; a printing mechanism for effecting a printing operation by electrifying a photosensitive member of the photosensitive unit, applying a light beam to the electrified photosensitive member to form an electrostatic latent image thereon, developing the electrostatic latent image to create a visible image and then transferring the image to printing paper, a nonvolatile memory section for storing data indicating the printing history of the photosensitive unit; and processing section for updating the data stored in the nonvolatile memory section each time the printing operation is effected, checking whether the data stored in the nonvolatile memory section has reached a value corresponding to a service life of the photosensitive unit, and generating a replacement requiring signal when it is detected that the data stored in the nonvolatile memory section has reached the value.

In this printing device, the nonvolatile memory section stores data indicating the printing history of the photosensitive unit, and this data is updated each time the printing operation is effected. Since the total number of the printing operations is directly reflected to the content of the nonvolatile memory section, it is possible to replace the photosensitive unit at an optimum replacement time.

DETAILED DESCRIPTION OF THE PREFERRED EMBODIMENTS

There will now be described a laser printer according to a first embodiment of this invention with reference to FIGS. 1 to 10.

Figure 1:
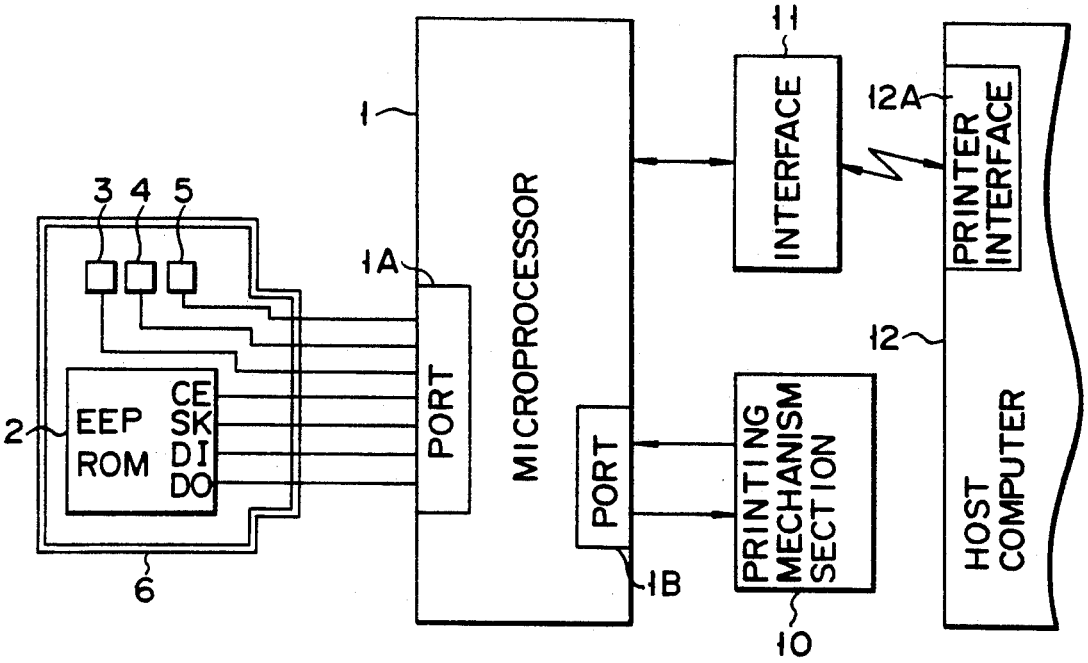
FIG. 1 is a diagram showing the circuit construction of a laser printer according to the first embodiment of the present invention.

FIG. 1 shows a circuit of the laser printer. The laser printer includes a microprocessor 1, a nonvolatile memory or EEPROM 2, a display unit 3 for displaying the normal state of a photosensitive drum which will be described later in detail, a display unit 4 for displaying the to-be-replaced state of the photosensitive drum and a display unit 5 for displaying the service life state of the photosensitive drum. The sections 2 to 5 are connected to the microprocessor 1. The EEPROM 2 is connected to a port 1A of the microprocessor 1. The EEPROM 2 has a clock signal input terminal SK, an input port DI to which signals are serially input in synchronism with the clock signal, an output port DO, and an enable signal input terminal CE.

Figure 2:
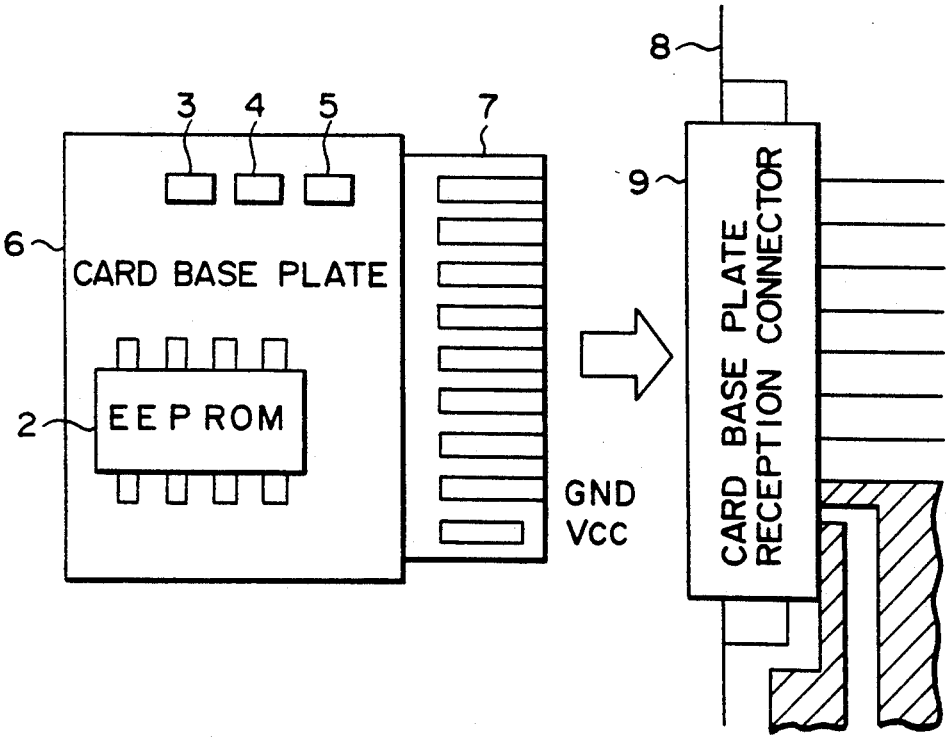
FIG. 2 is a diagram showing the connecting section between card base plate and microprocessor shown in FIG. 1.

As shown in FIG. 2, the EEPROM 2 and the display units 3 to 5 are mounted on a card base plate 6. An edge connector 7 is formed on one end of the card base plate 6 and the EEPROM 2 and the display units 3 to 5 can be electrically connected to the port 1A by inserting the edge connector 7 into a reception connector 9 provided on the main body 8 of the printer.

A mechanism section 10 is connected to a port 1B of the microprocessor 1. Further, the microprocessor 1 is connected to a printer interface 12A of an external host computer 12 via an interface logic circuit 11.

Figure 3:
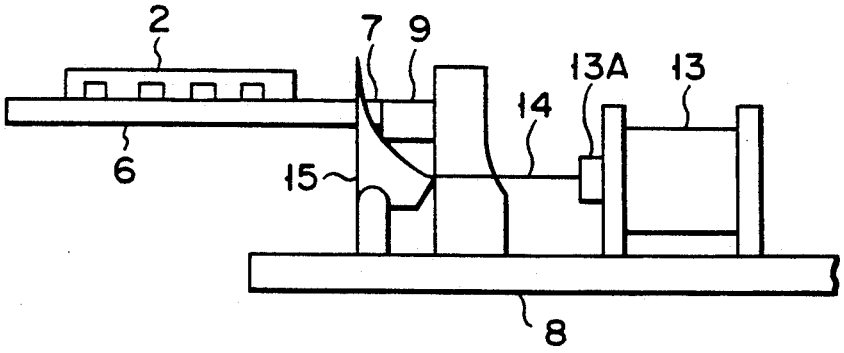
FIGS. 3 and 4 are diagrams showing the ejecting mechanism for the card base plate shown in FIG. 2.
Figure 4:
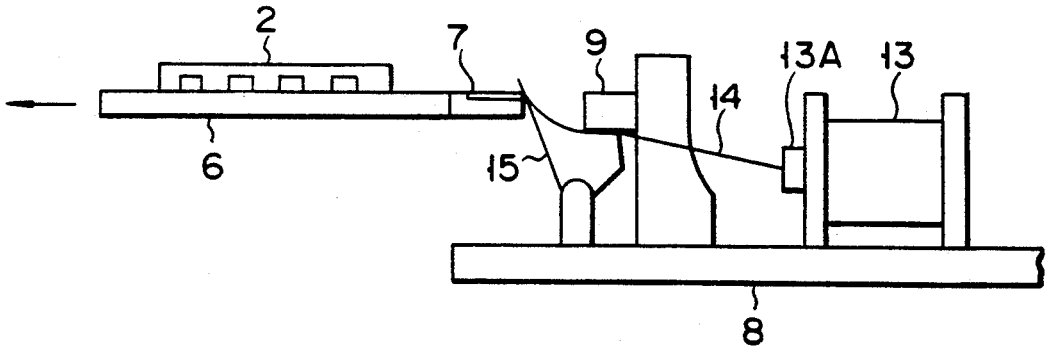

As shown in FIGS. 3 and 4, a card ejection solenoid 13 is provided in the main body 8 of the printer and a core 13A of the solenoid 13 is connected to a card ejecting arm 15 via a coupling rod 14. As shown in FIG. 3, the card ejecting arm 15 is engaged with part of the edge connector 7 of the card base plate 6 when the card base plate 6 is inserted into the connector 9. When the card ejecting solenoid 13 is operated, the card ejecting arm 15 is pushed out to separate the edge connector 7 of the card base plate 6 away from the connector 9 as shown in FIG. 4. That is, the card ejecting solenoid 13, coupling rod 14 and card ejecting arm 15 are combined to constitute a card ejecting mechanism.

Figure 5:
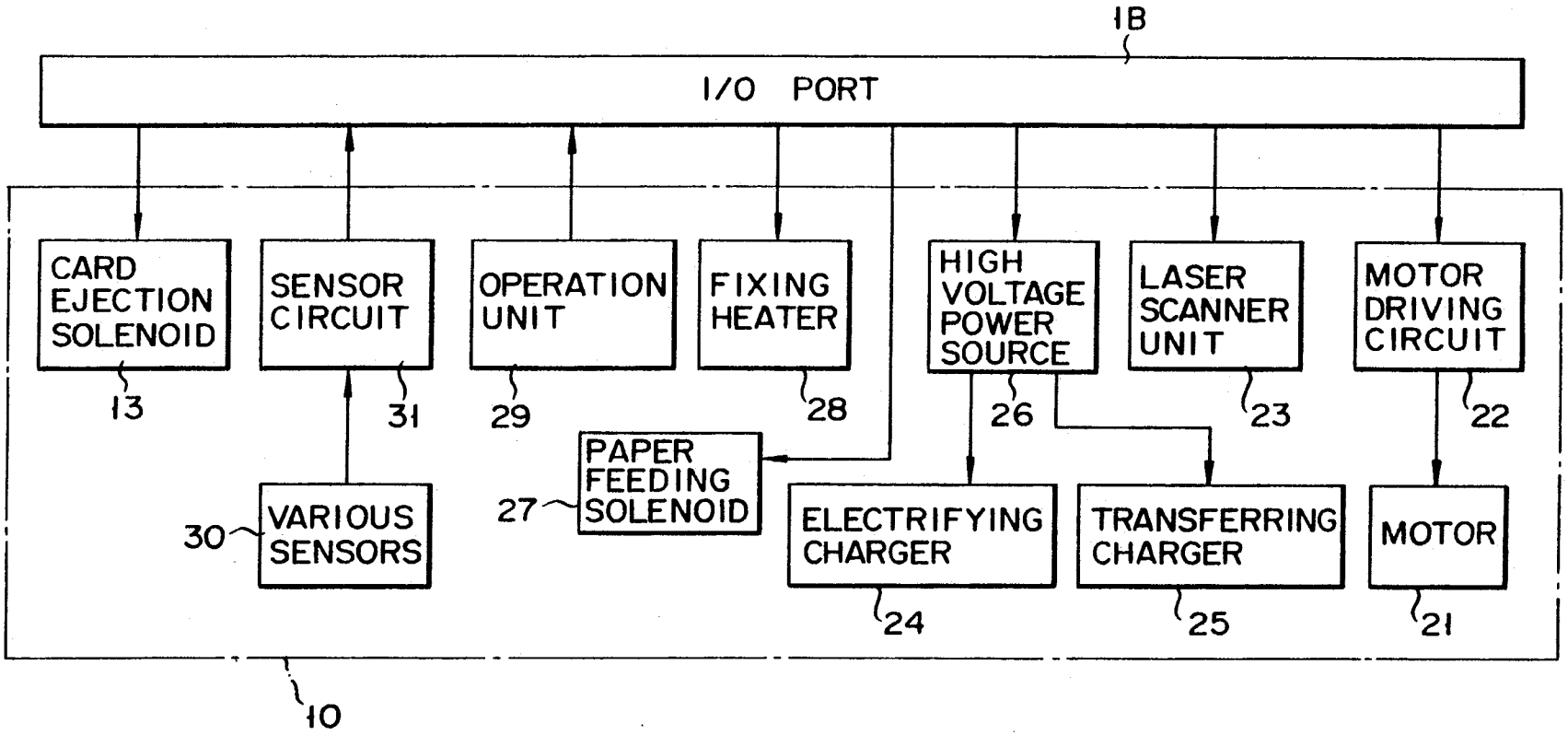
FIG. 5 is a diagram showing the construction of printing mechanism section shown in FIG. 1.

As shown in FIG. 5, the mechanism section 10 includes a motor 21 for driving a roller provided to feed transfer paper and rotate the photosensitive drum to be described later, a motor driving circuit 22 for driving the motor 21, a laser scanner unit 23 for scanning the photosensitive surface of the photosensitive drum by applying a laser beam to the photosensitive surface of the photosensitive drum according to data supplied from the host computer 12, a high voltage power source 26 for applying a high voltage to an electrifying charger 24 and transferring charger 25, a paper feeding solenoid 27, a fixing heater 28, an operation unit 29, various sensors 30 including a toner empty sensor and a plurality of paper sensors disposed on the feeding path of the image transferring paper, a sensor circuit 31 for controlling the various sensors 30, and the card ejection solenoid 13.

Figure 6:
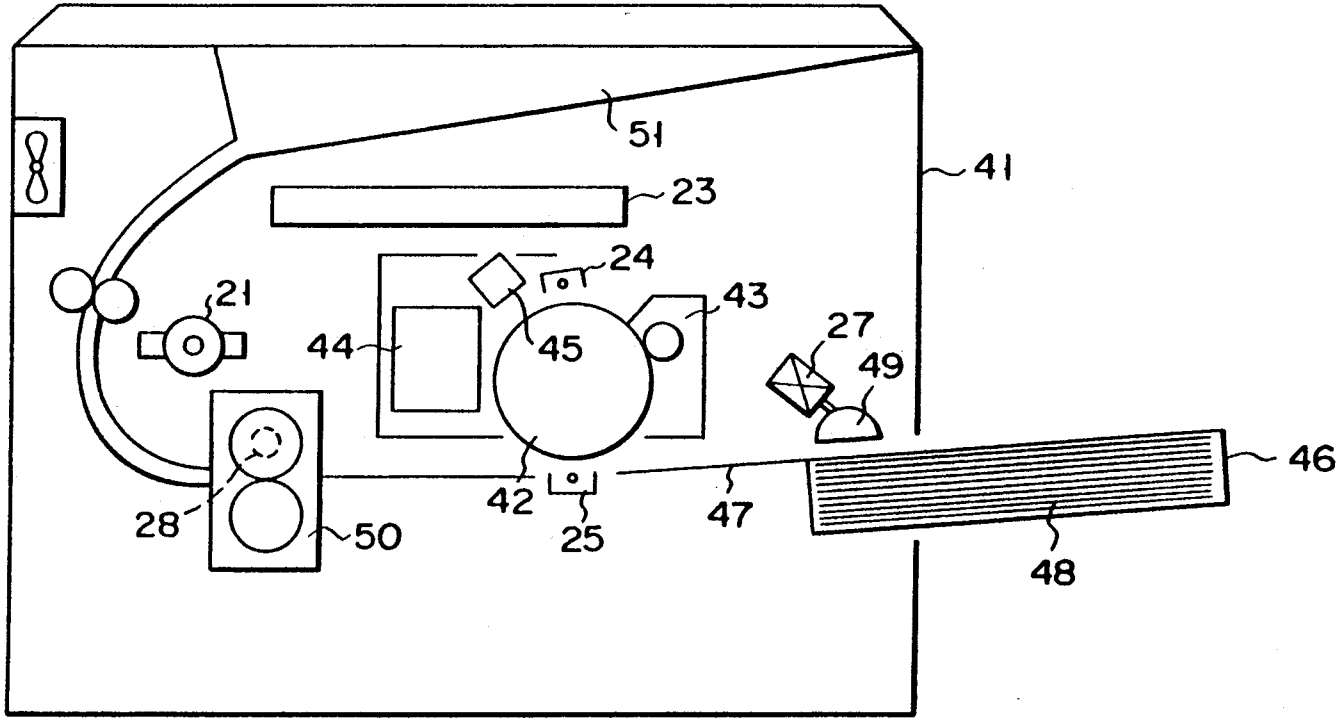
FIG. 6 is a diagram showing the internal structure of the laser printer according to the first embodiment.

FIG. 6 shows the internal structure of the laser printer. A photosensitive drum 42 is disposed in the substantially central portion of a casing 41.

The electrifying charger 24, laser scanner unit 23, developing unit 43 for supplying toner, transferring charger 25, cleaning unit 44 for removing toner from the photosensitive drum 42 and de-electrifying lamp 45 for de-electrifying the photosensitive drum 42 are disposed around the photosensitive drum 42.

The laser scanner unit 23 includes a laser oscillator, a polygon mirror for changing the projection direction of a laser beam, and a polygon motor for driving the polygon mirror. When the laser scanner unit 23 scans a laser beam on the photosensitive surface electrified by the electrifying charger 24, an electrostatic latent image is formed on the photosensitive surface. The electrostatic latent image is changed into a visible image by toner supplied from the developing unit 43.

Sheets of transferring paper are stacked in a paper supplying section 46, and supplied from the paper supplying section 46 one by one and fed to the transferring charger 25 by means of the feeding unit 47. The transferring charger 25 transfers the toner image formed on the photosensitive drum onto the transferring paper 48. A pick-up roller 49 is driven by the paper feeding solenoid 27 to feed out the transferring paper 48 from the paper supplying section 46.

The transferring paper 48 is fed from the transferring charger 25 to a fixing roller 50 which is heated by the fixing heater 28. After the toner is thermally fixed on the transferring paper 48, the transferring paper is fed to the ejecting section 51 and ejected therefrom.

Figure 7:
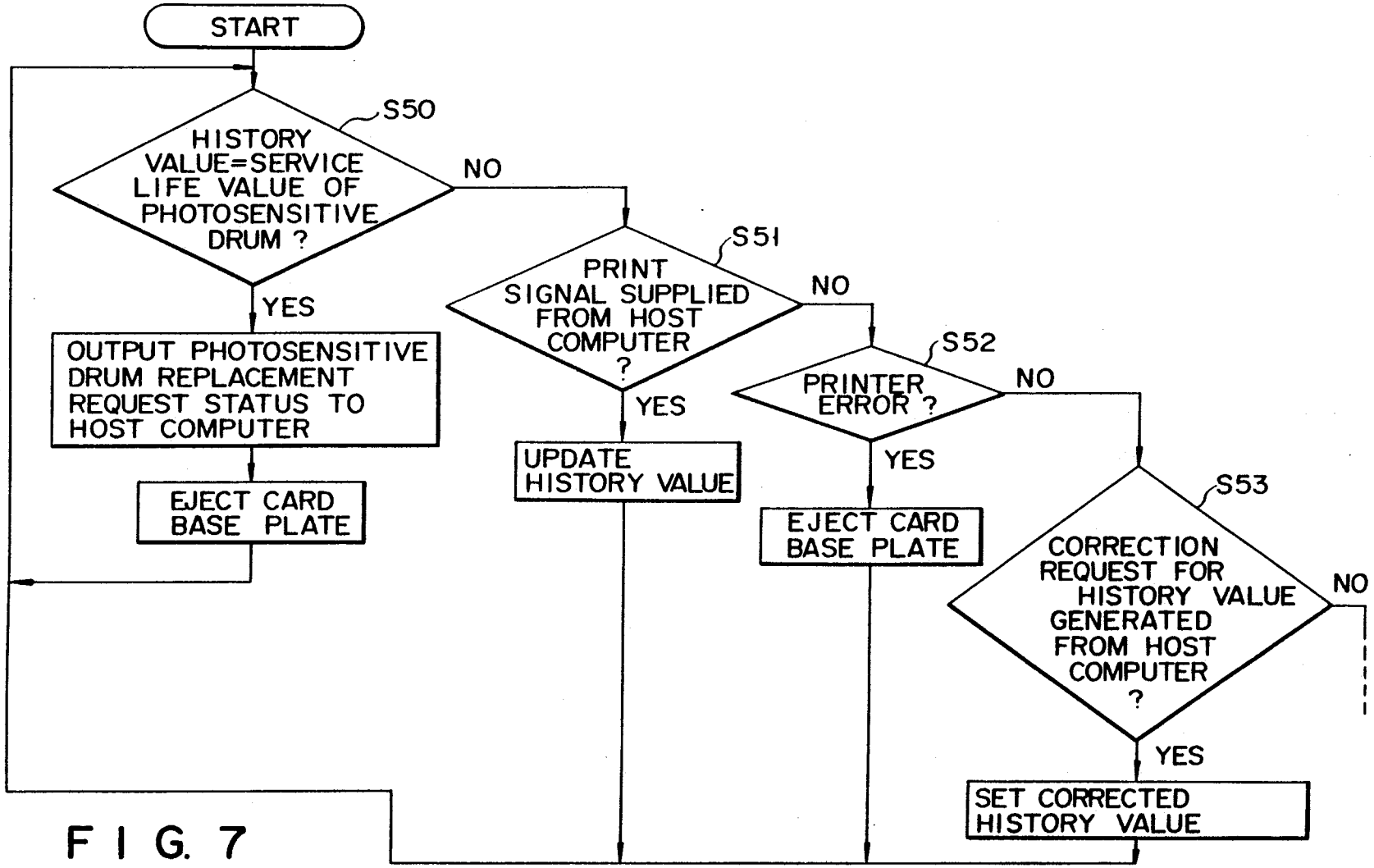
FIG. 7 is a flowchart for illustrating the photosensitive drum controlling process performed by the microprocessor shown in FIG. 1.
Figure 8:
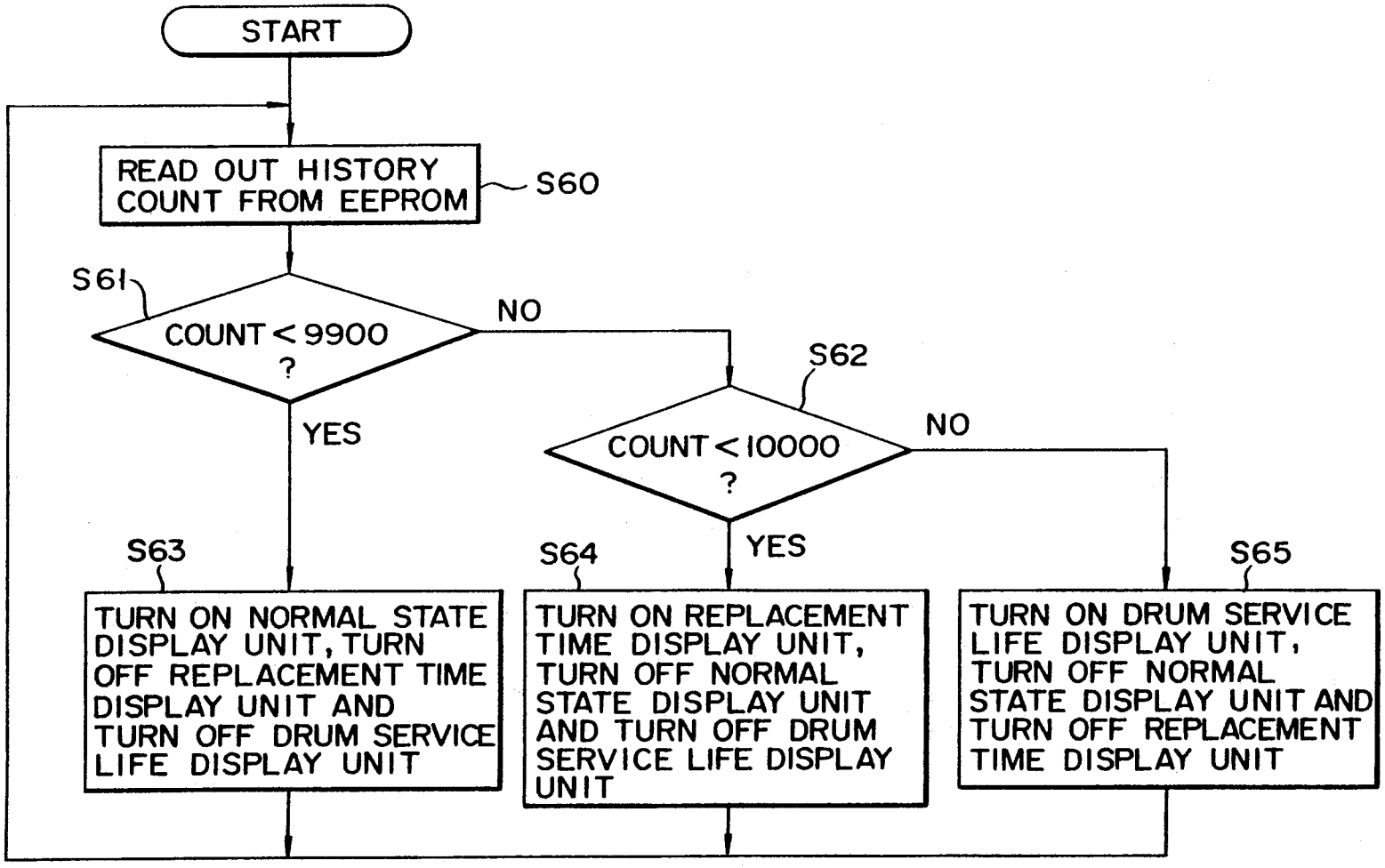
FIG. 8 is a flowchart for illustrating the displaying process performed by the microprocessor shown in FIG. 1.

The microprocessor 1 is designed to effect the process of controlling the photosensitive drum shown in FIG. 7 and the displaying process shown in FIG. 8.

In the process of controlling the photosensitive drum, the printing history indicating value is checked in the step S50. The step S50 includes a process of checking that the printing history indicating value of "0" is set in the EEPROM 2 mounted on a card base plate 6 which is inserted into the connector 9 when a new photosensitive drum 42 is set.

When it is detected in the step S50 that the printing history indicating value stored in the EEPROM 2 has not reached the service life of the photosensitive drum 42, it is checked in the step S51 whether or not a print starting signal is supplied from the host computer 12. If the print starting signal is not present, it is checked in the step S52 whether a printer error has occurred or not, and if no printer error is detected, it is checked in the step S53 whether a correction request for the printing history indicating value is supplied from the host computer 12 or not.

If it is detected in the step S51 that the print starting is supplied from the host computer 12, the printing history indicating value stored in the EEPROM 2 is updated, and the printing operation is effected. In the printing operation, the motor 21 and the polygon motor of the laser scanner unit 23 are driven. After this, it is checked whether or not the polygon mirror is rotated in synchronism with a constant rotation within a predetermined period of time. If it does, a cut sheet feeder operating signal is generated to drive the paper feeding solenoid 27. In response to this, the pick-up roller 49 is operated to feed out the transfer paper 48 from the paper supplying section 46 to the paper feeding path 47.

Further, the photosensitive drum 42 is rotated by means of the motor 21 and the photosensitive surface thereof is electrified by means of the electrifying charger 24. After this, the photosensitive surface is scanned by and exposed to a laser beam from the laser scanner unit 23 so as to form an electrostatic latent image on the photosensitive surface. Then, when the developing unit 43 supplies toner to the photosensitive surface, the toner is selectively attached to the photosensitive surface to change the electrostatic latent image into a visible image. In the image transferring section, the transfer paper 48 is electrified by the transferring charger 25 and thus a toner image is transferred onto the transfer paper 48. After this, the transfer paper 48 is thermally fixed by means of the fixing roller 50, fed to the ejecting section 5 and ejected therefrom.

If it is detected in the step S50 that the printing history count stored in the EEPROM 2 has reached a number corresponding to the service life of the photosensitive drum 42, for example, 10000, a replacement request for the photosensitive drum 42 is output as a status signal to the host computer 12. After this, when the card ejecting solenoid 13 is driven to move the card base plate ejecting arm 15, the card base plate 6 is removed from the connector 9. When the host computer 12 has received a replacement request from the printer, it informs the operator that the photosensitive drum should be replaced.

If an error occurs in the printer for some reason, the card ejecting solenoid 13 drives the card base plate ejecting arm 15 so as to remove the card base plate 6 from the connector 9.

When a correction request for the printing history count is generated from the host computer 12, the printing history count stored in the EEPROM 2 is corrected. The correction operation includes a process of clearing the printing history count.

In the display process shown in FIG. 8, the microprocessor 1 reads out the printing history indicating value from the EEPROM 2 in the step S60 so as to check the service life of the photosensitive drum.

Then, it is checked in the step S61 whether or not the history count is smaller than 9900 which is near the service life value and it is checked in the step S62 whether or not the history count is smaller than 10000 which is equal to the service life value. When the history count is smaller than 9900, the normal state display unit 3 is turned on and the replacement time display unit 4 and drum service life display unit 5 are turned off in the step S63. When the history count lies in the range of 9900 to 9999, the replacement time display unit 4 is turned on and the normal state display unit 3 and drum service life display unit 5 are turned off in the step S64. Further, when the history count is equal to or larger than 10000, the drum service life display unit 5 is turned on and the normal state display unit 3 and replacement time display unit 4 are turned off in the step S65.

In this embodiment with the above construction, when a new photosensitive drum 42 is set, a card base plate 6 on which an EEPROM having a printing history count of "0" stored therein is mounted is inserted into the connector 9.

If, under this condition, the printing operation is started in response to a print starting signal from the host computer 12, the printing history count in the EEPROM 2 is updated or incremented by "1", for example, each time the printing operation is effected.

The microprocessor 1 periodically reads out and checks the printing history count of the EEPROM 2. In the initial period of time after the photosensitive drum 42 is replaced, the printing history indicating value is small and therefore the drum is determined to be set in the normal state so that the normal state display unit 53 will be turned on. Thus, it informs the user of the present situation.

After this, when the printing operation is repeatedly effected, the printing history count becomes gradually larger. When the history count becomes near the service life value, the microprocessor 1 determines that the replacement time for the photosensitive drum 42 has come and turns on the replacement time display unit 4, thus informing the user of the present situation. In this case, the user may prepare a new photosensitive drum and a card base plate before the service life of the drum now used has come to an end.

If, under this condition, the printing operation is further repeatedly effected, the printing history indicating value becomes equal to the service life value. At this time, the microprocessor 1 turns on the service life display unit 5, thus informing the user of the present situation. At the same time, the microprocessor 1 causes the card ejecting solenoid 13 to drive the card ejecting arm 15 so as to remove the card base plate 6 from the connector 9. Therefore, the user replaces the photosensitive drum 42 by a new photosensitive drum and inserts a new card base plate into the connector 9, thus making it possible to effect the printing operation.

In this way, since the printing history count which is updated in each printing operation is stored into the EEPROM 2 which is a nonvolatile memory and the photosensitive drum 42 is replaced when the history count has reached the number corresponding to the service life of the drum, it becomes unnecessary to use a relatively expensive toner sensor unlike the conventional case, and the economical efficiency can be enhanced. Further, unlike the method of detecting that the used-toner box is filled with used toner, the service life of the drum can be always correctly detected in this invention. Therefore, the photosensitive drum can be securely controlled. Further, since the EEPROM 2 is mounted on the card base plate 6 and the EEPROM 2 can be exchanged by exchanging the card base plate 6, the treatment thereof is easy.

Since the printing history count stored in the EEPROM 2 is repeatedly read out and the display units 3, 4 and 5 are selectively turned on according to the read-out history count, the optimum replacement time of the photosensitive drum can be easily obtained and preparation for replacement of the photosensitive drum 42 can be easily made.

The card base plate 6 is automatically ejected when the printing history count has reached the service life value of the photosensitive drum. Therefore, the replacement operation of the card base plate can be simplified.

Figure 9:
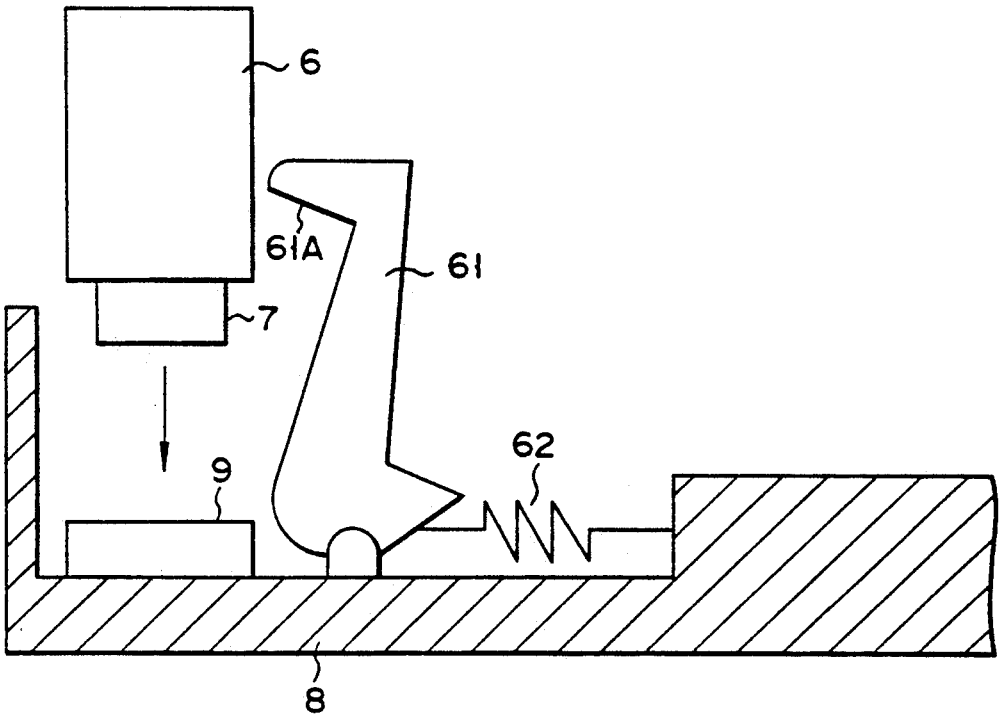
FIGS. 9 and 10 are diagrams showing examples of a mechanism section for preventing the removal of the card base plate shown in FIG. 2.
Figure 10:
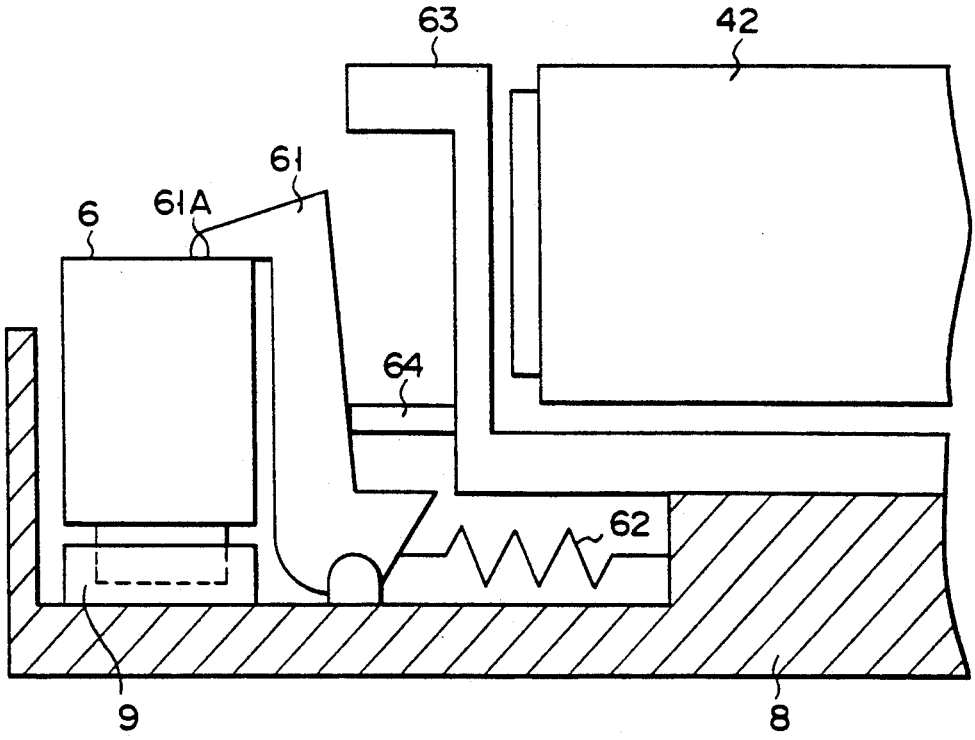

In the above embodiment, when the service life of the photosensitive drum 42 is terminated, the card base plate 6 is automatically ejected by using the card ejecting solenoid 13, coupling rod 14 and card base plate ejecting arm 15. However, the construction is not limited to the above embodiment, but can be made as shown in FIGS. 9 and 10, for example. That is, in this example, one end of a card holding arm 61 is supported on the main body 8 of the printer and the card holding arm 61 is supported by means of a spring 62 so that the other end of the card holding arm 61 can be rotated by a small angle in a clockwise direction in the drawing. Further, when the card base plate 6 is inserted into the card base plate reception connector 9 and then the photosensitive drum 42 is set, a projection 64 formed on a drum unit 63 rotates the card holding arm 61 in a counterclockwise direction against the force of the spring 62 so as to engage an engaging portion 61A formed on the other end portion of the card holding arm 61 with the rear end of the card base plate 6 and prevent the card base plate 6 from being removed. With this construction, the card base plate can be securely held in connection with the connector 9 in a period from the time when the photosensitive drum is set until it is replaced.

Next, a laser printer according to a second embodiment of this invention is described with reference to FIGS. 11 to 15.

Figure 11:
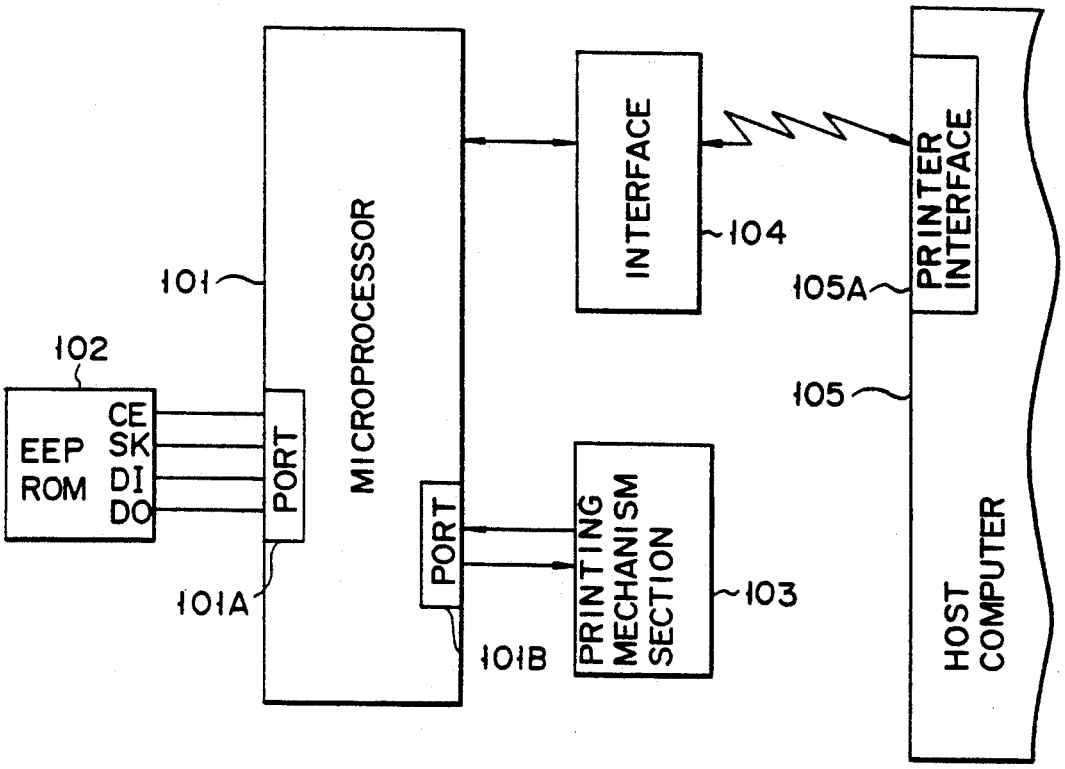
FIG. 11 is a diagram showing the circuit construction of a laser printer according to the second embodiment of the present invention.
Figure 12:
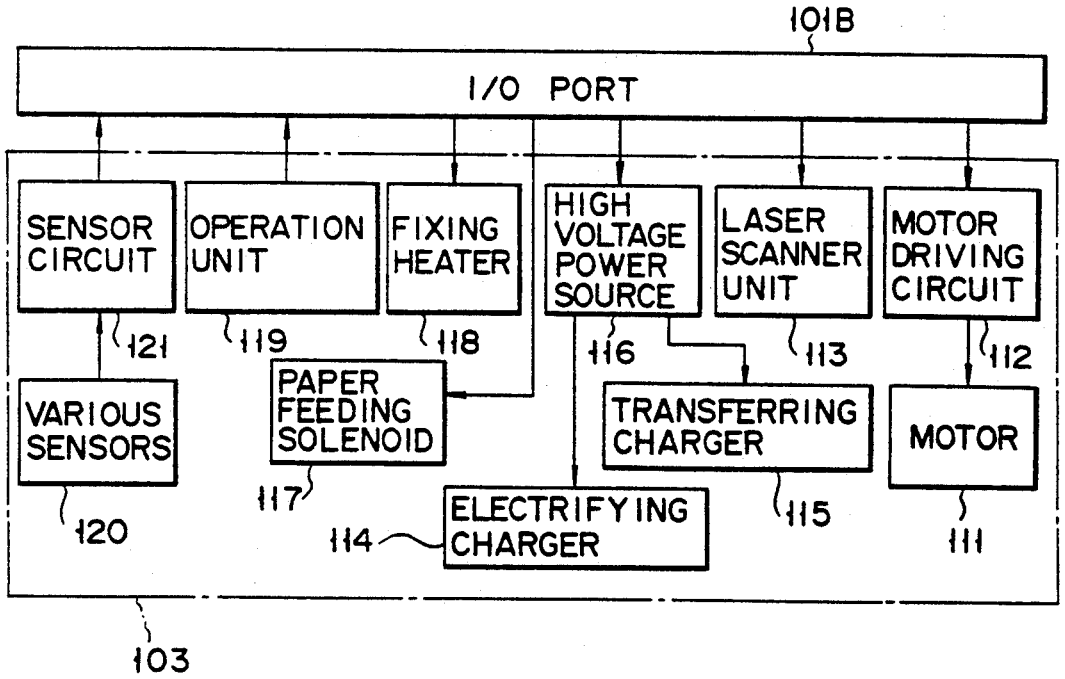
FIG. 12 is a diagram showing the printing mechanism section shown in FIG. 11.

FIG. 11 shows a circuit of the laser printer. The laser printer includes a microprocessor 101, a non-volatile memory or EEPROM 102 connected to a port 101A of the microprocessor 101 and a printing mechanism 103 connected to a port 101B of the microprocessor 101. The microprocessor 101 is connected to an interface logic circuit 104 which is in turn connected to a printer interface 105A of an external host computer 105.

The printing mechanism 103 includes a motor 111 for driving a roller provided to rotate a photosensitive drum to be described later and feed transfer paper, a motor driving circuit 112 for driving the motor 111, a laser scanner unit 113 for scanning the photosensitive surface of the photosensitive drum by applying a laser beam to the photosensitive surface of the photosensitive drum according to data supplied from the host computer 105, a high voltage power source 116 for applying a high voltage to an electrifying charger 114 and transferring charger 115, a paper feeding solenoid 117, a fixing heater 118, an operation unit 119, various sensors 120 including a toner empty sensor and a plurality of paper sensors disposed on the feeding path of the image transferring paper, and a sensor circuit 121 for controlling the various sensors 120.

Figure 13:
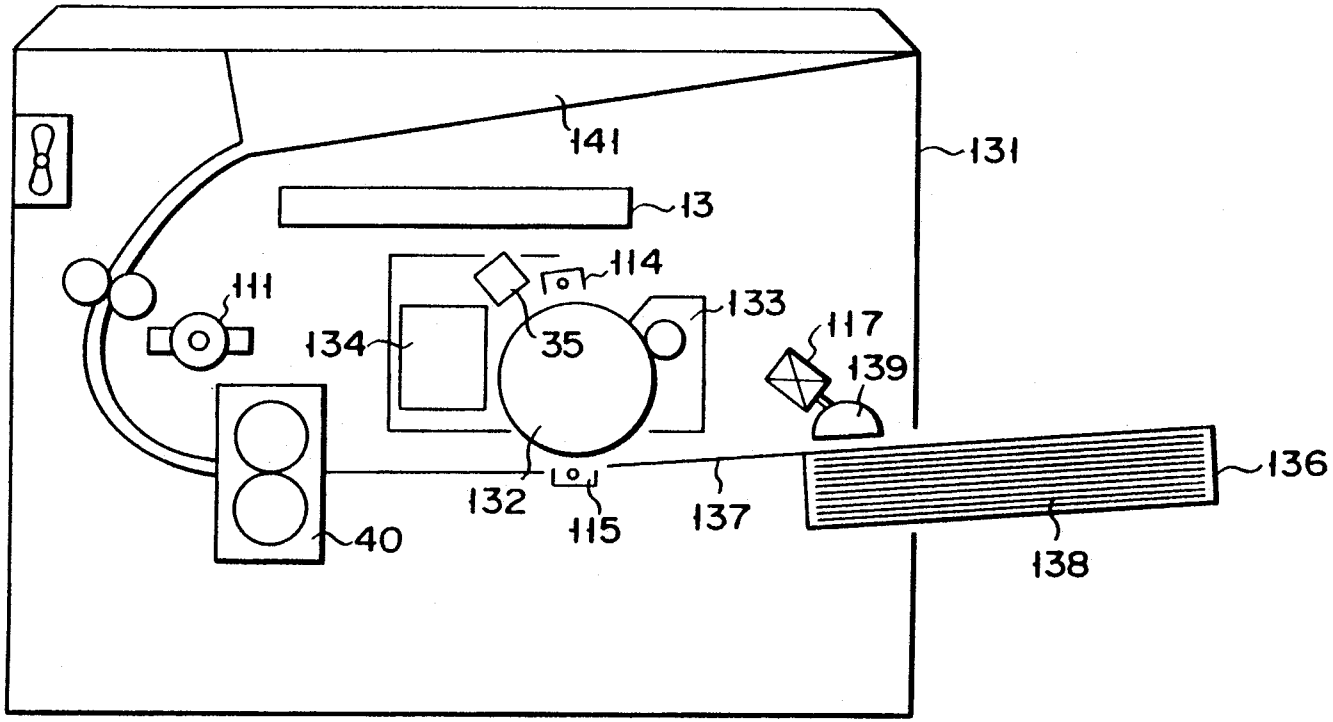
FIG. 13 is a diagram showing the internal construction of the laser printer according to the second embodiment.

FIG. 13 shows the internal structure of the laser printer. A photosensitive drum 132 is disposed in the central portion of a casing 131.

The electrifying charger 114, laser scanner unit 113, developing unit 133 for supplying toner, transferring charger 115, cleaning unit 134 for removing toner from the photosensitive drum 132 and de-electrifying lamp 135 for de-electrifying the photosensitive drum 132 are disposed around the photosensitive drum 132.

The laser scanner unit 113 includes a laser oscillator, a polygon mirror for changing the projection direction of a laser beam, and a polygon motor for rotating the polygon mirror. When the laser scanner unit 113 scans a laser beam on the photosensitive surface electrified by the electrifying charger 114, an electrostatic latent image is formed on the photosensitive surface. The electrostatic latent image is changed into a visible image by toner supplied from the developing unit 133.

Sheets of transferring paper are stacked in a paper supplying section 136, and supplied from the paper supplying section 136 one by one and fed to the transferring charger 115 by means of the feeding unit 137. The transferring charger 115 transfers the toner image formed on the photosensitive drum onto the transferring paper 138. A pick-up roller 139 is driven by the paper feeding solenoid 117 to feed out the transferring paper 138 from the paper supplying section 136.

The transferring paper 138 is fed from the transferring charger 115 to the fixing roller 140 which is heated by the fixing heater 118. After the toner is thermally fixed on the transferring paper 138, the transferring paper is fed to the ejecting section 141 and ejected therefrom.

Figure 14:
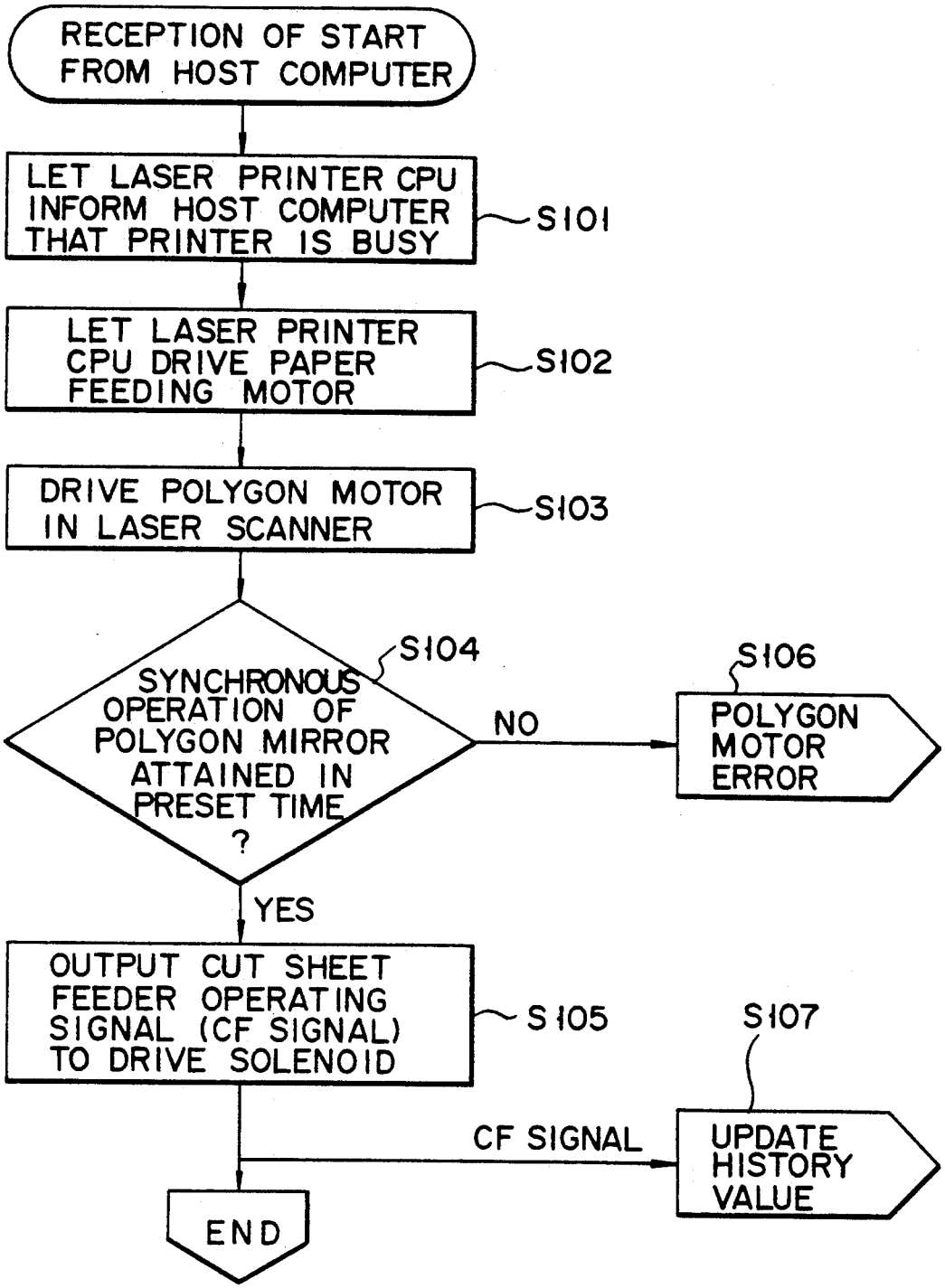
FIG. 14 is a flowchart for illustrating the print control operation performed by the microprocessor shown in FIG. 11.

The microprocessor 101 is designed to effect the controlling process shown in FIG. 14 in response to a print starting request supplied from the host computer 105.

That is, when the microprocessor 101 receives the print starting request, it supplies a printer busy signal to the host computer 105 in the step S101, drives the motor 111 in the step S102, and drives the polygon motor of the laser scanner unit 113 in the step S103. After this, it is checked in the step S104 whether or not the polygon mirror is rotated in synchronism with a constant rotation within a predetermined period of time. If it does, a cut sheet feeder operating signal (CF signal) is generated to drive the paper feeding solenoid 117. In response to this, the pick-up roller 139 is operated to feed out the transfer paper 138 from the paper supplying section 136 to the paper feeding path 137. If the polygon mirror is not rotated in synchronism with a constant rotation within a predetermined period of time, an error process for the polygon motor is effected in the step S106.

When the cut sheet feeder operating signal is output, a history updating operation is effected in the step S107.

Figure 15:
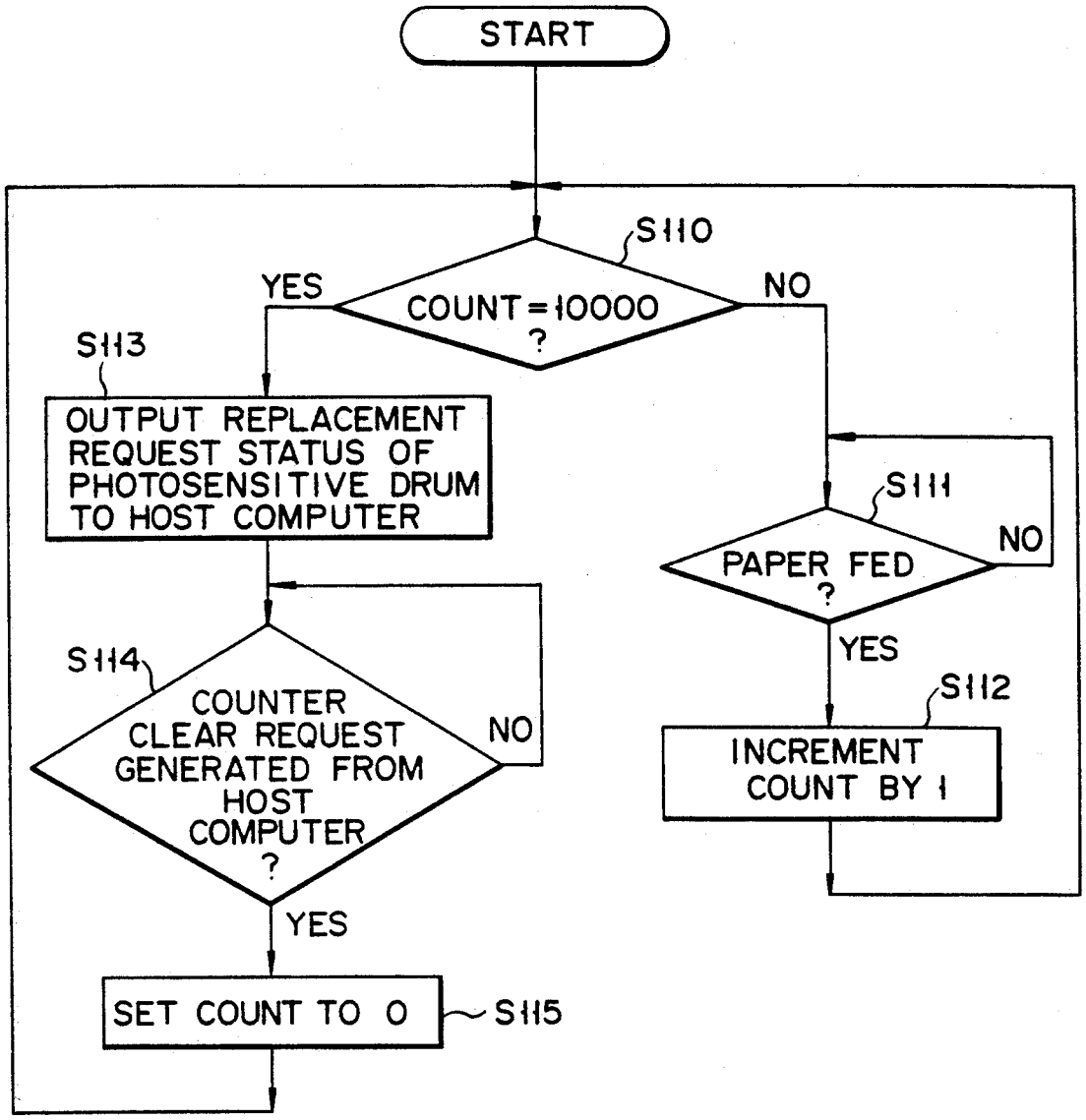
FIG. 15 is a flowchart for illustrating the history value updating process performed by the microprocessor shown in FIG. 11.

FIG. 15 shows the history updating process. Before shipment from the factory, data "0" is previously set as a history count into the EEPROM 102.

In the history updating process, it is checked in the step S110 whether or not the content or the history count of the EEPROM 102 is set at 10000 which is defined as a preset number corresponding to the service life of the photosensitive drum 132.

If the history count is not equal to 10000, it is set in the standby state until it is detected in the step S111 that the paper is fed. When the paper is fed in response to the cut sheet feeder operating signal, the content or history count of the EEPROM 102 is incremented in the step S112.

When the history count has reached 10000, a replacement request of the photosensitive drum 132 is supplied as a status signal to the host computer 105.

In the next step S114, it waits for a counter clear request supplied from the host computer 105 after the photosensitive drum has been replaced. If the counter clear request is received, the history count of the EEPROM 102 is clear to "0" in the step 115. In this case, the microprocessor 101 inhibits the printing operation until the counter clear request from the host computer 105 is received.

In the second embodiment with the above construction, when the print starting signal from the host computer 105 is received, the motor 111 is first driven and then the polygon motor of the laser scanner unit 113 is driven.

Then, a cut sheet feeder operating signal is generated, and the paper feeding solenoid 117 is operated to drive the pick-up roller 139 so as to supply a sheet of transfer paper 138 from the paper supplying section 136 to the feeding path 137. At this time, the count of the EEPROM 102 is incremented by "1".

The photosensitive drum 132 is rotated by means of the motor 111, and the photosensitive surface is electrified by the electrifying charger 114 and then scanned by and exposed to a laser beam from the laser scanner unit 113 to form an electrostatic latent image. Toner is attached to the electrostatic latent image by means of the developing unit 133 so that the electrostatic latent image may be changed into a visible image. The visible toner image is transferred onto the transfer paper 138 which is electrified by the transferring charger 115 in the transferring unit. The transfer paper 138 having the toner image transferred thereon is thermally fixed by the fixing roller 140 and then ejected by the ejecting unit 141.

In this way, the printing operation for one sheet of paper is completed. When a plurality of sheets of paper are printed, a cut sheet feeder operating signal is repeatedly generated at a preset time interval, and the paper feeding solenoid 117 and pick-up roller 139 are operated at the preset time interval so as to sequentially feed sheets of transfer paper 138 one by one from the paper supplying section 136 to the feeding path 137. Then, the count in the EEPROM 102 is incremented by "1" each time a cut sheet feeder operating signal is output.

Thus, the printing operation is repeatedly effected, and when the count in the EEPROM 102 has reached 10000, a replacement request of the photosensitive drum is transmitted from the microprocessor 101 to the host computer 105. In response to the replacement request, the host computer 105 displays message of replacement of the photosensitive drum on a CRT display unit, for example, and when detecting the responding operation effected by the operator, the host computer 105 transmits a counter clear request to the microprocessor 101. In this way, the microprocessor 101 clears and initializes the history count of the EEPROM 102 to "0".

After this, when the photosensitive drum is replaced by the operator, the EEPROM 102 re-starts the service life counting operation for the newly set photosensitive drum.

In this way, since the number of printing operations can be measured by means of the history counter of the EEPROM 102, the photosensitive drum can be replaced at an adequate time. Further, since the history counter of the EEPROM 102 is cleared each time the photosensitive drum is replaced, it is not necessary to wastefully replace the memory. Further, since the EEPROM 102 is a nonvolatile memory, the count can be held even when the power source of the printer is interrupted.

Since the service life of the photosensitive drum is checked by counting the number of operations of the cut sheet feeder for driving the paper feeding solenoid 117, a special mechanism other than the sensors which are already provided is not necessary in order to count the number of feeder operations, simplifying the service life checking process.

Further, since the replacement of the photosensitive drum can be confirmed and the clear instruction for the EEPROM 102 can be generated by means of the host computer 105, it becomes easy to control the printer.

What is claimed is:

1. An electrophotographic printing device comprising:

a cartridge of a photosensitive unit;

a printing mechanism for effecting a printing operation by electrifying a photosensitive member of said photosensitive unit, applying a light beam to the electrified photosensitive member to form an electrostatic latent image thereon, developing the electrostatic latent image to create a visible image and then transferring the visible image to printing paper;

a nonvolatile memory means for storing data indicating a printing history of the photosensitive unit;

processing means for updating the data stored in said nonvolatile memory means each time the printing operation is effected, said processing means including means for checking whether the data stored in said nonvolatile memory means has reached a value corresponding to a service life of said photosensitive unit, and means for generating a replacement requiring signal when said checking means detects that the data stored in said nonvolatile memory means has reached said value, wherein said nonvolatile memory means is a nonvolatile memory card, and said processing means includes a connecting section to which said nonvolatile memory card is removably attached; and stopper means for preventing removal of said nonvolatile memory card when the photosensitive unit has been set in the printing device.

* * * * *